US011132932B2

(12) United States Patent
Behringer

(10) Patent No.: US 11,132,932 B2
(45) Date of Patent: Sep. 28, 2021

(54) METHOD OF OPERATING A LIGHT-EMITTING DEVICE

(71) Applicant: OSRAM Opto Semiconductors GmbH, Regensburg (DE)

(72) Inventor: Martin Rudolf Behringer, Regensburg (DE)

(73) Assignee: OSRAM OLED GMBH, Regensburg (DE)

( * ) Notice: Subject to any disclaimer, the term of this patent is extended or adjusted under 35 U.S.C. 154(b) by 0 days.

(21) Appl. No.: 16/484,755

(22) PCT Filed: Jan. 31, 2018

(86) PCT No.: PCT/EP2018/052419
§ 371 (c)(1),
(2) Date: Aug. 8, 2019

(87) PCT Pub. No.: WO2018/145974
PCT Pub. Date: Aug. 16, 2018

(65) Prior Publication Data

US 2020/0005700 A1 Jan. 2, 2020

(30) Foreign Application Priority Data

Feb. 8, 2017 (DE) ..... 102017102467.0

(51) Int. Cl.
*G09G 3/32* (2016.01)
*G09G 3/20* (2006.01)

(52) U.S. Cl.
CPC ..... *G09G 3/2074* (2013.01); *G09G 3/2003* (2013.01); *G09G 3/32* (2013.01); *G09G 2320/0242* (2013.01); *G09G 2330/10* (2013.01)

(58) Field of Classification Search
CPC ..... G09G 3/2074; G09G 3/2003; G09G 3/32; G09G 2320/0242; G09G 2330/10; G09G 2320/0233; G09G 2320/0693
See application file for complete search history.

(56) References Cited

U.S. PATENT DOCUMENTS 6,802,613 B2 * 10/2004 Agostinelli ..... H04N 9/3132 348/E9.026
7,408,558 B2 * 8/2008 Madden ..... H04N 9/3132 345/204

(Continued)

FOREIGN PATENT DOCUMENTS

CN 101854558 B * 4/2012
DE 202005020801 U1 9/2006

(Continued)

*Primary Examiner* — Temesghen Ghebretinsae
*Assistant Examiner* — Karin Kiyabu
(74) *Attorney, Agent, or Firm* — Slater Matsil, LLP

(57) ABSTRACT

A method for operating a light-emitting device includes operating, at least for some pixels, a selected subpixel of a pixel and at least one further subpixel of the pixel configured to emit light of a different color to display a pure color corresponding to a dominant wavelength of the selected subpixel and providing, at least for some pixels, a correction matrix associated with the pixel for adjusting brightness of the subpixels of the pixel, wherein the correction matrix is provided by determining, at least for some pixels, a brightness of each subpixel of the pixel necessary to emit light of a given color, determining, at least for some pixels, a dominant wavelength ($\lambda_r$, $\lambda_g$, $\lambda_b$) of each subpixel, plotting dominant wavelengths ($\lambda_r$, $\lambda_g$, $\lambda_b$) of each subpixel in a CIE-XY color space and forming color triangles, and determining inner triangles of the color triangles in pairs.

9 Claims, 4 Drawing Sheets

(56) References Cited

U.S. PATENT DOCUMENTS

| | | | | |
|---|---|---|---|---|
| 7,586,497 | B2 * | 9/2009 | Boroson | H01L 27/3213 345/590 |
| 8,274,525 | B2 * | 9/2012 | Langendijk | G09G 5/02 345/590 |
| 8,358,219 | B2 | 1/2013 | Heggen | |
| 9,953,590 | B2 * | 4/2018 | Ben-David | G09G 5/02 |
| 10,847,075 | B1 * | 11/2020 | Buckley | G09G 3/2003 |
| 2004/0046720 | A1 | 3/2004 | Nagai et al. | |
| 2007/0257866 | A1 | 11/2007 | Cok | |
| 2009/0086170 | A1 * | 4/2009 | El-Ghoroury | H01S 5/4043 353/38 |
| 2011/0062874 | A1 | 3/2011 | Knapp | |
| 2011/0141716 | A1 * | 6/2011 | Wiesmann | G02F 1/133603 362/97.1 |
| 2019/0027082 | A1 * | 1/2019 | Van Belle | G09G 5/10 |
| 2020/0150491 | A1 * | 5/2020 | Jang | H05B 45/20 |
| 2020/0333603 | A1 * | 10/2020 | Noguchi | G09G 5/02 |

FOREIGN PATENT DOCUMENTS

| | | | | |
|---|---|---|---|---|
| DE | 102012209252 | A1 * | 12/2013 | H05B 47/18 |
| DE | 102012209252 | A1 | 12/2013 | |
| EP | 1548695 | A1 * | 6/2005 | G09G 3/22 |

* cited by examiner

METHOD OF OPERATING A LIGHT-EMITTING DEVICE

This patent application is a national phase filing under section 371 of PCT/EP2018/052419, filed Jan. 31, 2018, which claims the priority of German patent application 102017102467.0, filed Feb. 8, 2017, each of which is incorporated herein by reference in its entirety.

TECHNICAL FIELD

A method of operating a light-emitting device is specified.

BACKGROUND

U.S. Pat. No. 8,358,219 B2 describes a method of operating a light-emitting device.

SUMMARY OF THE INVENTION

Embodiments provide a method by which particularly cost-effective light-emitting devices can be operated. Further embodiments provide a particularly efficient method for operating a light-emitting device.

According to an embodiment of the method of operating a light-emitting device, a light-emitting device is provided. The light-emitting device is, for example, a display device with which images, characters and/or symbols are displayed directly. It is also possible that the light-emitting device is a lighting device that can be used for general lighting, in a motor vehicle headlamp or for backlighting an imaging element such as an LCD panel.

The light-emitting device comprises a plurality of pixels. The pixels are the light-emitting elements of the light-emitting device. Each pixel emits light during operation. The individual pixels of the light-emitting device can be operated separately from each other, simultaneously or simultaneously in predefined groups. If the light-emitting device is a display device, the pixels may in particular be the imaging elements of the display device.

The pixels can, for example, be individual light-emitting semiconductor chips or areas of light-emitting semiconductor chips. In particular, the light-emitting device may comprise a plurality of pixels. It is also possible for each pixel to comprise two or more light-emitting semiconductor chips.

The light-emitting semiconductor chips are in particular light-emitting diode chips.

According to at least one embodiment of the method, each pixel comprises at least three subpixels configured to emit light of different colors in pairs. The subpixels are subunits of each pixel that can be operated separately or simultaneously. For example, each pixel includes at least one subpixel that emits red light during operation. This subpixel is also called red subpixel. It is also possible for each pixel to comprise at least one subpixel that emits green light during operation. This subpixel is also called green subpixel. In addition, it is possible that each pixel comprises at least one subpixel that emits blue light during operation. This subpixel is also called blue subpixel in the following.

Furthermore, it is possible that each pixel comprises additional subpixels that emit light of other colors or white light. In particular, the subpixels enable each pixel to emit light of different colors. The light can be the colored light of any subpixel. Furthermore, the light may be a mixed light composed of the light of two or more subpixels.

It is possible that each subpixel is formed by a single light-emitting semiconductor chip. It is also possible that each pixel is formed by exactly one light-emitting semiconductor chip divided into the subpixels. In this case, two or more of the different colors generated by the subpixels of the pixel can be generated using conversion and/or filter elements arranged downstream of the subpixel, for example.

According to at least one embodiment of the method, at least for some or all of the pixels, to display a pure color corresponding to the dominant wavelength of a selected subpixel of the pixel, the selected subpixel and at least one further subpixel of the pixel configured to emit light of a different color are operated. The dominant wavelength indicates the color impression perceived by the human eye. The dominant wavelength lies on the spectral color line in the CIE-XY color diagram. From the color point of the generated light, a straight line is drawn through the white point in the diagram and the point of intersection with the spectral color line which has the smallest section to the white point, forms the dominant wavelength.

A "pure color" is understood here and in the following in particular as a spectral color. For example, pure color is the color impression produced by a monochromatic light selected from the visible part of the light spectrum. It is the most intense color in any shade.

For example, a pixel is to emit light of a pure color and the pixel comprises a certain subpixel that generates light of a dominant wavelength corresponding to the pure color to be displayed. It would now be possible and obvious to operate only the red subpixel to generate the light of the desired pure color.

According to the method described here, however, in addition to the corresponding subpixel, at least one subpixel of the pixel of a different color is operated, so that mixed light with a red color impression is emitted from the pixel.

According to an embodiment, a method of operating a light-emitting device is specified, wherein—the light-emitting device comprises a plurality of pixels, —each pixel comprises at least three subpixels configured to emit light of different colors in pairs, —at least for some pixels, to display a pure color corresponding to the dominant wavelength of a selected subpixel of the pixel, the selected subpixel and at least one further subpixel of the pixel configured to emit light of a different color are operated.

The method of operating a light-emitting device described here is based, among other things, on the following considerations: In the manufacture of light-emitting semiconductor components, such as light-emitting diode chips, which can form pixels or subpixels described here, there are also differences in the wavelength of the light emitted by the light-emitting semiconductor components in a wafer in which a plurality of semiconductor components of the same type are manufactured simultaneously. One speaks of a so-called wavelength course over the wafer.

If the light-emitting semiconductor components are used, for example, as parts of pixels or as pixels in a display device, this can lead to unwanted color differences. This means that if, for example, homogeneous blue light is to be produced by the display device, it may be visible to the naked eye that the wavelength of the blue light produced varies across the emitting surface of the display device, depending on the semiconductor component which produces the blue light.

Unwanted color differences or gradients produced in this way can be minimized if the light-emitting semiconductor chips are sorted according to wavelengths and/or other criteria, for example, before they are mounted at their destination. To avoid failures in particular, all light-emitting semiconductor chips are measured and unsuitable semiconductor chips are sorted out. This leads to a particularly complex and cost-intensive production of light-emitting devices.

In contrast, a method described here can be used to operate light-emitting devices without presorting the light-emitting semiconductor components which, for example, form the pixels or subpixels of the light-emitting device. This is achieved by operating not only the selected subpixel but at least one further subpixel of the pixel to display a pure color corresponding to the dominant wavelength of a selected subpixel of the pixel, e.g., to display red, green and blue light, in particular pure red, green and blue light.

In other words, wavelength inhomogeneities are not prevented by presorting, but compensated by operating not only the associated subpixel to generate light of a certain wavelength, but at least one further subpixel of a pixel.

In this way, the color locations of the pure light generated by each pixel can be moved to a common color location generated by mixing the light of two or more subpixels of different colors. This reduces the color space in which the light-emitting device can generate light compared with a light-emitting device in which the individual subpixels are operated individually to generate pure light. However, moving to a common color location for some or all pixels has the advantage that presorting is not necessary. The rule by which the color locations are moved to display pure colors can then be applied to all colors to be displayed. In this way, when the device is operating, light of a given color location is generated by each pixel with great precision at the same color location without the chips that form the pixels or parts of the pixels having been presorted for this purpose.

According to at least one embodiment of the method, at least for some pixels all subpixels are operated to display each given color. This means that at least for some pixels of the light-emitting device, no single subpixel is used to display any color, but all colors to be displayed are generated by color mixing. For example, a brightness of the subpixels is selected such that as many pixels as possible of the light-emitting device emit light of a selected color at the same color location.

According to at least one embodiment of the method, at least for some pixels a correction matrix associated with the pixel is provided with which the brightness of the subpixels of the pixel can be adjusted. In other words, a correction matrix may be provided for some pixels, in particular each pixel of the light-emitting device, with which the brightness of the individual subpixels can be adjusted in such a way that each pixel emits light of a given color at the same color location.

According to at least one embodiment of the method, to provide the correction matrix, the brightness of each subpixel of the pixel necessary to emit light of a given color is determined. This means, for example, that it is predefined that a certain color location in the color location range of red light is used to display pure red light. The correction matrix is then selected for each pixel such that the brightness of the subpixels is set in such a way that this red light is emitted by the pixel. This can mean that the proportions of emitted red, green and blue light which are necessary to produce the desired red light vary from pixel to pixel.

According to at least one embodiment of the method, each pixel comprises exactly three subpixels configured to emit light of different colors in pairs. These are, for example, a red subpixel, a green subpixel and a blue subpixel. At least for some pixels, the dominant wavelength of each subpixel is determined. This determination can also be made for all pixels of the light-emitting device.

The dominant wavelength of each subpixel is then plotted in the CIE-XY color space and the points of the subpixels of a pixel are connected to form color triangles. This means that the dominant red, the dominant green and the dominant blue wavelengths are drawn on the spectral color line and connected to form a color triangle. This is done for each pixel of the considered pixels, for example, of the display.

Subsequently, the largest inner triangle of the color triangles, which results from the intersections of two of the considered color triangles in each case, is determined in pairs. The corner points in the CIE-XY color space of the inner triangle with the largest area then form the given colors. The correction matrix is then used to adjust the brightness of each subpixel of a pixel such that the pixel emits light with the given color.

This correction matrix can be used to display any color within the inner triangle, wherein the brightness levels specified, for example, by a display system, such as a video system, are changed to target brightness levels by means of the correction matrix.

Instead of calculating an inner triangle, it is also possible to specify a specific inner triangle. The corner points of this inner triangle are then used to determine the correction matrix. In this way, a correction matrix can also be generated for each pixel. Such a method, in which the inner triangle is predetermined without prior measurement at the pixels of the light-emitting device, is particularly possible if a variation range is known or is predetermined in the manufacture of the light-emitting semiconductor components which form the pixels or the subpixels of the light-emitting device.

In this way, a data sheet can be created independently of the specific wavelengths of the light generated by the subpixels. Since there is no need to sort and discard light-emitting semiconductor components which form the pixels or subpixels of the light-emitting device, this is a particularly cost-effective operating method.

In the method described, the dominant wavelengths of each subpixel of all pixels or of some pixels can be used. In particular, if a pixel contains defective subpixels that cause the corner points of the color triangle assigned to the pixel to deviate significantly from the corner points of the color triangles of other pixels, these pixels may not be considered. In other words, in this case it is not the largest inner triangle of all color triangles that is determined but, for example, the largest inner triangle that applies to at least 90% or at least 95%, in particular at least 99%, of the pixels of the light-emitting device.

According to at least one embodiment of the method, the current intensity at which each subpixel is operated depends on entries in the correction matrix. For example, the brightness of the red, green and blue light of a given pixel as specified by the display system is represented as a vector, which is multiplied by the correction matrix. This gives the actual brightness selected for the red, green and blue values of the pixel when displaying the desired color. To determine the current intensity, this vector for the red, green and blue values is multiplied by a characteristic curve that reflects the functional relationship between brightness and current intensity.

According to at least one embodiment of the method, to determine the current intensity at which subpixels are operated, a brightness correction is performed, in which the brightness of the subpixels is normalized to a median value for at least some or all of the pixels. This means that subpixels of a certain color, for example, red subpixels, are operated with a stronger current to produce the same brightness at which other red subpixels produce red light at a lower current. For example, a monochrome image, for example, a monochrome red image, can be determined for certain different current values. This results in a "gray value" for each subpixel and the respective current intensity. The median of all gray values (also median gray value) at a certain current intensity can then be normalized to 1 in a correction table for the subpixels that have this gray value, and in the correction table the values for all other subpixels are set to the quotient of median gray value by measured gray value. This correction table can then again be represented as a matrix with correction values for the red, green and blue subpixels of each pixel.

According to at least one embodiment of the method, for at least some of the pixels for each subpixel the number of damaged neighboring subpixels of the same color can be determined and an undamaged subpixel can be operated at a current intensity which is greater the greater the number of its damaged neighboring subpixels of the same color. This means that a red subpixel, for example, has eight neighboring red subpixels, each of which is assigned to a different pixel. If the considered red subpixel is now damaged, the red subpixels arranged around the subpixel can be operated at a higher current intensity to correct the damage of the subpixel.

Whether a subpixel is damaged can be decided according to a predefined criterion. For example, the criterion can be that the subpixel produces at most M % of a certain target power. M can then be 20 or 50, for example. The choice of M depends on the field of application of the light-emitting device. For example, if the light-emitting device is mainly used in a dark environment, a subpixel that only achieves 15% or 20% of the target power can also be considered an undamaged subpixel. In particular, the method makes it possible to distribute the differential power of a subpixel among the neighboring subpixels, i.e., the weaker a subpixel shines, the brighter the neighboring subpixels are operated in order to compensate for the damage to the subpixel.

BRIEF DESCRIPTION OF THE DRAWINGS

In the following, the method described here is explained in more detail using exemplary embodiments and the corresponding figures.

Identical, similar or identically acting elements are provided with the same reference signs in the figures. The figures and the proportions of the elements depicted in the figures are not to be regarded as true to scale. Rather, individual elements may be represented exaggeratedly large for better representability and/or better comprehensibility.

DETAILED DESCRIPTION OF ILLUSTRATIVE EMBODIMENTS

Figure 1:
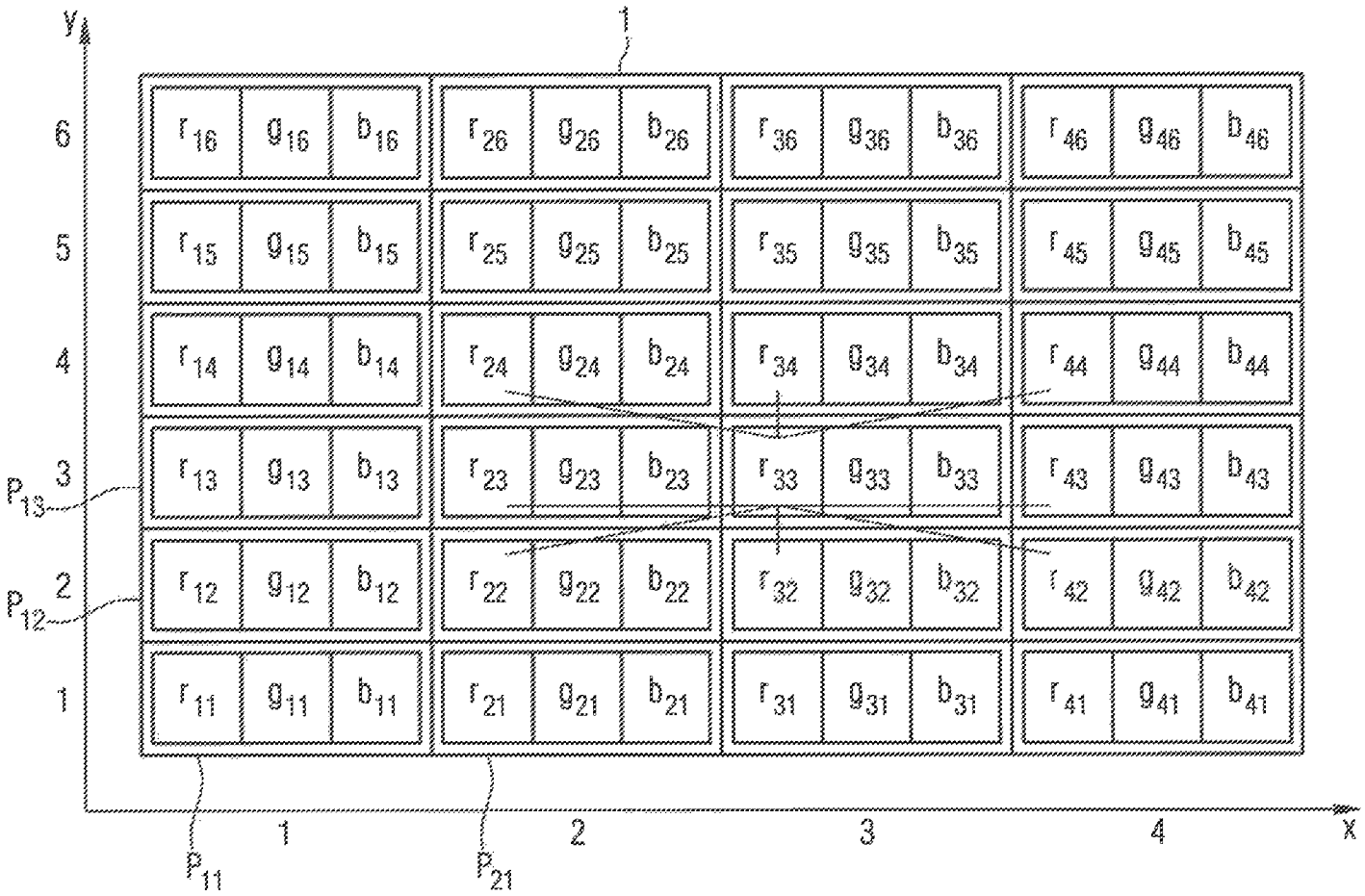
FIG. 1 shows a schematic top view of a light-emitting device which is operated according to an exemplary embodiment of a method.

FIG. 1 shows a schematic top view of a light-emitting device as can be operated with a method described here. The light-emitting device comprises a plurality of pixels P. In FIG. 1, the pixels P are provided with the indices xy according to their position in a coordinate system spanned by the coordinates x and y.

In the exemplary embodiment, each pixel P comprises exactly three subpixels r, g, b, which are red, green and blue subpixels. The subpixels have the same index as the pixels P.

In an exemplary embodiment of a method of operating a light-emitting device described herein, at least for some pixels, to display a color corresponding to the color of a selected subpixel r, g, b of the pixel P, the selected subpixel r, g, b and at least one further subpixel r, g, b of the pixel P configured to emit a different color are operated.

The current intensity at which each subpixel is operated can depend on entries in a correction matrix $M_{xy}$. Each Pixel $P_{xy}$ is assigned such a correction matrix $M_{xy}$.

Figure 2:
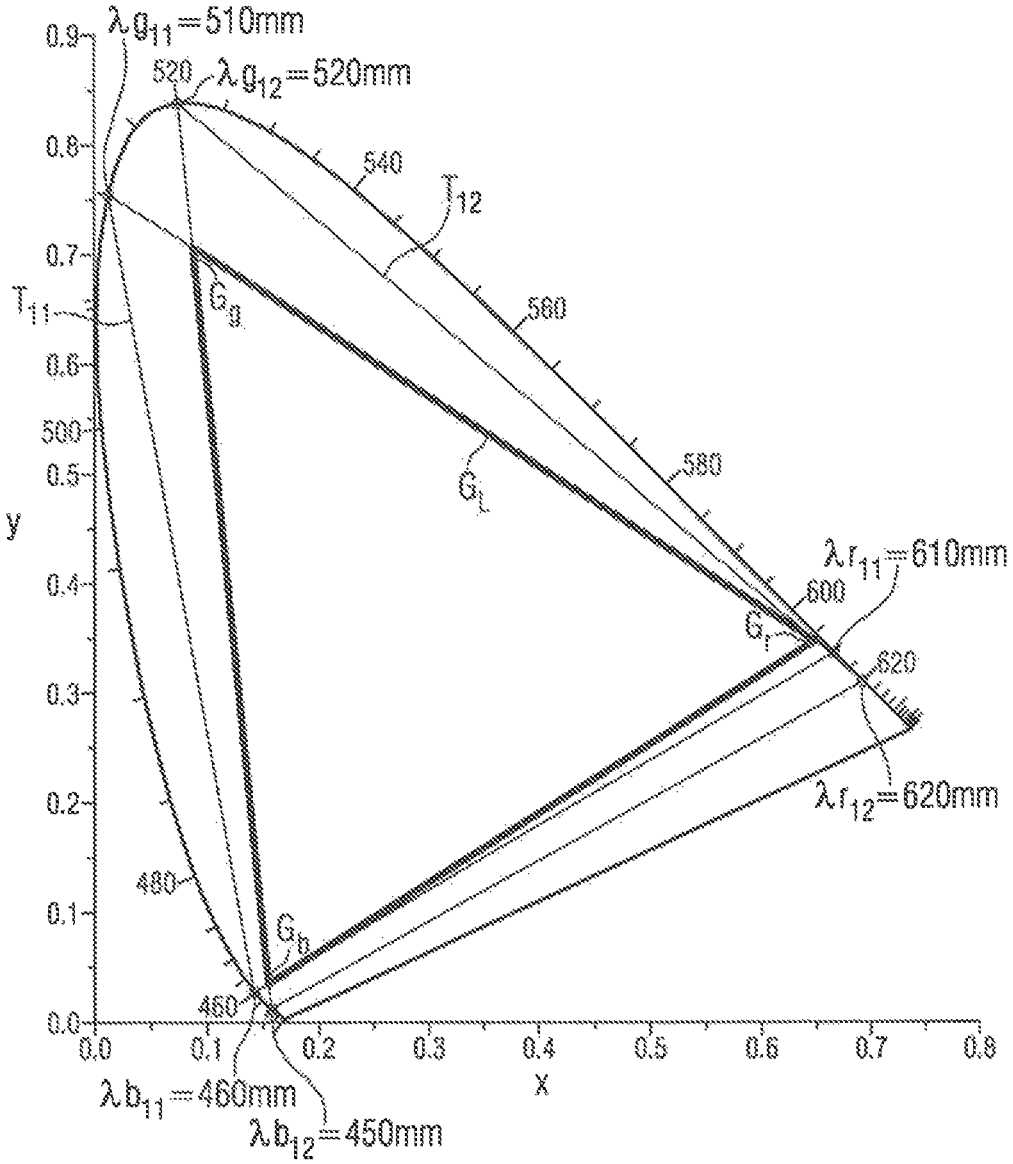
FIG. 2 shows a graphical representation to illustrate an exemplary embodiment of a method.
Figure 3:
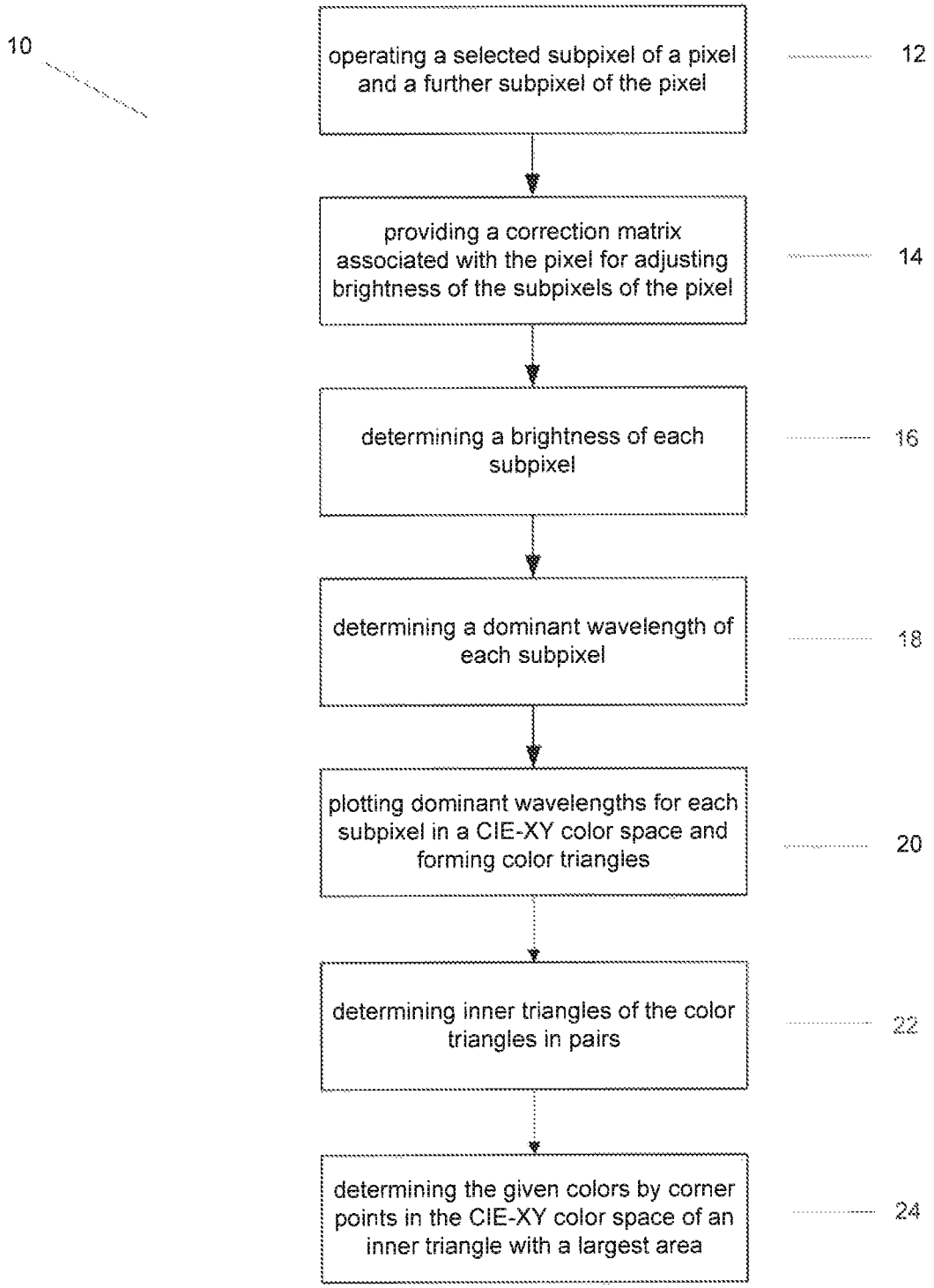
FIG. 3 shows a method for operating a light-emitting device according to an embodiment.
Figure 4:
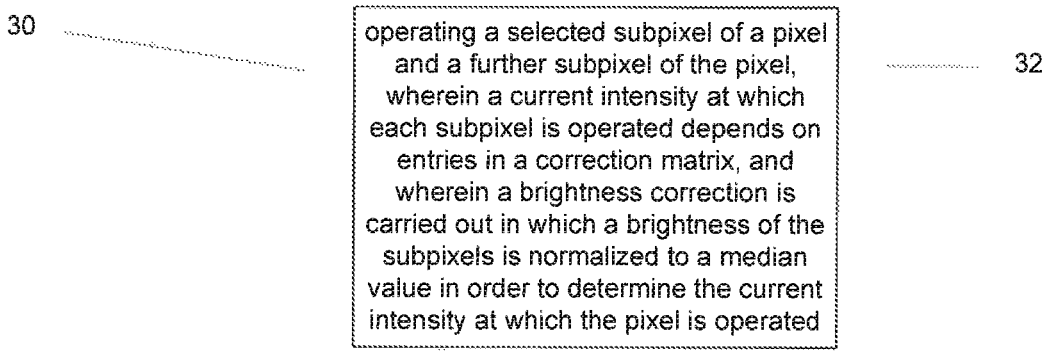
FIG. 4 shows a method for operating a light-emitting device according to an embodiment.

For determining the values of the correction matrix $M_{xy}$, corner points of a color triangle can be used, for example. The color triangle G, see FIG. 2, is spanned by the corner points $G_r$, $G_g$, $G_b$, for example. Each of these corner points represents a pure color. In the CIE-XY diagram, for example, the corner point $G_g$ represents the color location which, for the light-emitting device, should correspond to the color location of pure green light of a certain dominant wavelength. The correction matrix $M_{xy}$ is selected such that the brightness of the red, green and blue subpixels of a target value is corrected to the desired value for each pixel $P_{xy}$. With the correction matrix calculated in this way, each target value can then be converted to a corresponding actual value according to the formula:

$$\begin{pmatrix} r \\ g \\ b \end{pmatrix}_{actual,\,xy} = M_{xy} \begin{pmatrix} r \\ g \\ b \end{pmatrix}_{target,xy},$$

where:

$$M_{xy} = \begin{pmatrix} r_{k1} & r_{k2} & r_{k3} \\ g_{k1} & g_{k2} & g_{k3} \\ b_{k1} & b_{k2} & b_{k3} \end{pmatrix}_{xy}$$

The entries $r_{K1}$, $r_{K2}$ . . . in the correction matrix $M_{xy}$ are then the correction values for each pixel $P_{xy}$. Without a further correction of the brightness, the current intensity $I_r$, $I_g$, $I_b$ for each subpixel r, g, b then results to $$\begin{pmatrix} I_r \\ I_g \\ I_b \end{pmatrix}_{xy} = \vec{f} \begin{pmatrix} r \\ g \\ b \end{pmatrix}_{actual,xy}$$

Here "f" is a function that can be determined from the current/brightness characteristic curve for each subpixel.

The inner triangle G can be specified from the outside and selected, for example, according to a known production fluctuation in the manufacture of the semiconductor components that form the pixels or subpixels.

It is also possible, however, to measure the individual pixels of the light-emitting device to determine the inner triangle G. For example, the dominant wavelengths $\lambda_{r,g,b,xy}$ of each subpixel are determined for this purpose. In FIG. 2, the dominant wavelengths for the subpixels of pixels P11 and P12 are entered as examples in the CIE-XY diagram. The points representing the dominant wavelengths are connected to form color triangles $T_{xy}$. The intersection of the color triangles forms the inner triangle G. This method can be carried out for all pixels $P_{xy}$ of the light-emitting device and the largest inner triangle G in terms of area can be selected for determining the correction matrix. It is also possible that not all pixels are considered, but damaged pixels or pixels whose dominant wavelengths are clearly shifted in relation to the remaining pixels are not used to determine the largest inner triangle G.

The nominally identical subpixels of the individual pixels $P_{xy}$ of the light-emitting device, for example, all red subpixels of the pixels, can differ not only with regard to their dominant wavelength, but also with regard to their brightness when operated at a certain current intensity. The method described here can therefore also involve brightness correction, wherein it is assumed for simplicity's sake that the dominant wavelength of the light generated by a subpixel is independent of the current intensity at which the subpixel is operated.

To correct the brightness, monochrome images are first determined at certain different current values and gray values are generated for each subpixel and the respective current intensity. The gray value is used to assess the brightness and is independent of the wavelength. A median gray value for all subpixels of a given color is set to 1 and a correction vector $C_{xy}$ is provided for each pixel, where:

$$\vec{C}_{xy} = \begin{pmatrix} c_r \\ c_g \\ c_b \end{pmatrix}_{xy}$$

For simplicity's sake, it is assumed that the correction value is the same for all relevant operating currents. Otherwise, the correction value must be considered power-dependent.

The entries of the correction vector are:

$$c_{i,xy} = \frac{m_i}{Gw_{i,xy}};\ i = r, g, b$$

where $m_i$ is the median value for all red subpixels i=r, all green subpixels i=g or all blue subpixels i=b and $Gw_{i,xy}$ is the measured gray value for the respective subpixel at the considered current intensity.

The current intensity for each pixel $P_{xy}$ then results to:

$$\begin{pmatrix} I_r \\ I_g \\ I_b \end{pmatrix}_{xy} = \vec{C}_{xy}\vec{f}\begin{pmatrix} r \\ g \\ b \end{pmatrix}_{actual,xy}$$

For example, $I_r$ is the current intensity for the red subpixel. As shown in FIG. 1, failure compensation can also be performed for each subpixel. For this purpose, the number of neighbors that are defective is first determined for each subpixel. The criterion when a subpixel is considered defective can be freely selected. For example, a subpixel is considered defective if it delivers only 50% or less of the target power at a certain current intensity.

The neighboring subpixels may be the nearest neighbours, as shown in FIG. 1. As an example, this is shown in FIG. 1 for subpixel $r_{33}$, whose closest neighbors are subpixels $r_{24}$, $r_{34}$, $r_{44}$, $r_{43}$, $r_{42}$, $r_{32}$, $r_{22}$ and $r_{23}$.

In a further embodiment of the method, the next-but-one neighbours of the subpixel can also be used.

In the method, first the number $N_D$ of the defective neighbors of a subpixel is determined. For subpixels with $N_D>0$, the neighboring subpixels must provide a compensation. The number of undamaged subpixels is determined for each defective subpixel. With eight nearest neighbors, this would be $8-N_D$, where $N_D$ is the number of defective neighbors of the defective subpixel. The target power of each non-defective subpixel is then increased by (target power of the defective subpixel)/$(8-N_D)$, summing over the neighboring subpixels.

It shall then apply for the so changed target power $p_{new}$ of the non-defective subpixel:

$$p_{new} = p_{target} + \sum_{i=1}^{N_D} p_{target,i} * \left(\frac{1}{8 - N_{D,i}}\right)$$

This method is performed for all subpixels of a pixel and all pixels.

In other words, an undamaged subpixel is operated at a current intensity that is greater the greater the number of its damaged neighboring subpixels of the same color, to compensate for the power loss caused by the damaged subpixels.

With the method described here, wavelength inhomogeneities can be compensated and these do not lead to a reduction in the quality of the light emitted by the light-emitting device. Expensive pre-measurement and sorting of the chips can be dispensed with and a particularly large proportion of the manufactured semiconductor components can thus be used to form the pixels or subpixels in the light-emitting device. This means that due to the described operating method, the scrap of non-usable light-emitting semiconductor components can be greatly reduced. The method described can also be used to pre-calibrate segments of larger light-emitting devices, for example, segments of display devices, to the corner points of a common inner triangle G and to join them together to form a larger light-emitting device, without undesirable color differences or color gradients occurring between the combined segments.

In a particular example, a method of operating a light-emitting device 10, wherein the light-emitting device comprises a plurality of pixels, and wherein each pixel comprises at least three subpixels configured to emit light of different colors in pairs is disclosed.

The method includes, in step 12, operating, at least for some pixels, a selected subpixel of a pixel and a further subpixel of the pixel configured to emit light of a different color to display a pure color corresponding to a dominant wavelength of the selected subpixel and, in step 14, providing, at least for some pixels, a correction matrix associated with the pixel for adjusting brightness of the subpixels of the pixel.

The correction matrix is provided by: step 16: determining, at least for some pixels, a brightness of each subpixel of the pixel necessary to emit light of a given color, step 18: determining, at least for some pixels, a dominant wavelength of each subpixel, step 20: plotting dominant wavelengths of each subpixel in an International Commission on Illumination chromaticity values x and y (CIE-XY) color space and forming color triangles, step 22: determining inner triangles of the color triangles in pairs; and step 24: determining the given colors by corner points in the CIE-XY color space of an inner triangle with a largest area. The steps are not necessarily operated in the order as recited.

In yet another example, a method of operating a light-emitting device 30, wherein the light-emitting device comprises a plurality of pixels, wherein each pixel comprises at least three subpixels configured to emit light of different colors in pairs is disclosed.

The method includes, in step, 32 operating, at least for some pixels, a selected subpixel of a pixel and at least one further subpixel of the pixel configured to emit light of a different color to display a pure color corresponding to a dominant wavelength of the selected subpixel of the pixel, wherein a current intensity at which each subpixel is operated depends on entries in a correction matrix, and wherein a brightness correction is carried out in which, for at least some of the pixels, a brightness of the subpixels is normalized to a median value in order to determine the current intensity at which subpixels are operated.

The invention is not limited to the exemplary embodiments by the description of the same. Rather, the invention includes any new feature and any combination of features, which in particular includes any combination of features in the patent claims, even if that feature or combination itself is not explicitly mentioned in the patent claims or exemplary embodiments.

The invention claimed is:

1. A method of operating a light-emitting device, wherein the light-emitting device comprises a plurality of pixels, and wherein each pixel comprises at least three subpixels configured to emit light of different colors in pairs, the method comprising:

operating, at least for some pixels, a selected subpixel of a pixel and a further subpixel of the pixel configured to emit light of a different color to display a pure color corresponding to a dominant wavelength of the selected subpixel; and providing, at least for some pixels, a correction matrix associated with the pixel for adjusting brightness of the subpixels of the pixel, wherein the correction matrix is provided by:

determining, at least for some pixels, a brightness of each subpixel of the pixel necessary to emit light of a given color;

determining, at least for some pixels, a dominant wavelength of each subpixel;

plotting dominant wavelengths of each subpixel in an International Commission on Illumination chromaticity values x and y (CIE-XY) color space and forming color triangles, wherein dominant wavelengths of each subpixel lie on a spectral line when the dominant wavelengths are plotted;

determining inner triangles of the color triangles in pairs, wherein each inner triangle is given by an intersection of the color triangles of each of the pair of color triangles; and determining the given colors by corner points in the CIE-XY color space of an inner triangle with a largest area.

2. The method according to claim 1, wherein, for at least some pixels, all subpixels are operated to display each given color.

3. The method according to claim 1, further comprising providing, for all pixels, a further correction matrix associated with the pixel, wherein the further correction matrix adjusts a brightness of the subpixels of the pixel.

4. The method according to claim 3, wherein the further correction matrix is provided by determining the brightness of each subpixel of the pixel.

5. The method according to claim 4, wherein each pixel comprises exactly three subpixels emitting light of different colors in pairs.

6. The method according to claim 1, wherein a current intensity at which each subpixel is operated depends on entries in the correction matrix.

7. The method according to claim 6, wherein, in order to determine the current intensity at which subpixels are operated, a brightness correction is carried out in which, for at least some of the pixels, the brightness of the subpixels is normalized to a median value.

8. The method according to claim 6, wherein, for determining the current intensity at which a subpixel is operated, a damage of neighboring subpixels of a same color is taken into account.

9. The method according to claim 8, wherein, for at least some of the pixels, for each subpixel a number of damaged neighboring subpixels of the same color is determined, and wherein an undamaged subpixel is operated at a current intensity which is greater the greater the number of its damaged neighboring subpixels of the same color.

* * * * *